United States Patent [19]

Zodrow et al.

[11] 4,439,262

[45] Mar. 27, 1984

[54] LABELING STATION FOR ARTICLES LIKE BOTTLES

[75] Inventors: Rudolf Zodrow, Düsseldorf; Egon Höveler, Haan; Heinz-Jürgen Rosenberg, Neuss, all of Fed. Rep. of Germany

[73] Assignee: Jagenberg AG, Düsseldorf, Fed. Rep. of Germany

[21] Appl. No.: 360,143

[22] Filed: Mar. 22, 1982

[30] Foreign Application Priority Data

Mar. 27, 1981 [DE] Fed. Rep. of Germany ..... 3112077
Feb. 16, 1982 [DE] Fed. Rep. of Germany ..... 3205414

[51] Int. Cl.[3] ..... B65C 9/10; B65C 9/16

[52] U.S. Cl. ..... 156/364; 156/568; 156/571; 156/573; 156/DIG. 29; 156/DIG. 32; 271/33; 271/124; 271/136

[58] Field of Search ..... 156/364, 564, 565, 568, 156/570, 571, 572, 573, DIG. 29, DIG. 30, DIG. 31, DIG. 32; 271/99, 124, 136, 138, 33, 137

[56] References Cited

U.S. PATENT DOCUMENTS 2,269,870 1/1942 Carter ..... 156/571
3,937,458 2/1976 Langen ..... 271/99
4,293,365 10/1981 Geyser et al. ..... 156/571

*Primary Examiner*—Michael G. Wityshyn
*Attorney, Agent, or Firm*—Sprung, Horn, Kramer & Woods

[57] ABSTRACT

In a labeling station that is intended for articles like bottles, that has at least one revolving or pivoting label grasper-applicator with a capture-and-release surface for taking a label from a stack and applying it to an article to be labeled, and that has holders that hold the edge of the stack of labels, the improvement which comprises controls for the holders (41, 42) or supplementary holders (45, 46) that hold the edge of the stack so that the retentive force the holders exert on the labels can be adjusted to be made greater than the attractive force exerted by the capture-and-release surface of the grasper-applicator (2, 3, 4) and, when the stack is held in a moving magazine, than the inertia exerted by the stack of labels on the stack holders as the magazine (6) moves backwards, the controls having a detector that scans the series of articles to be labeled and actuates the controls and the holders (41, 42 or 45, 46) when it senses a condition calling for a label not to be applied, e.g. a missing bottle in the series, an improperly filled bottle or a different kind of bottle than it is desired to label.

16 Claims, 6 Drawing Figures

LABELING STATION FOR ARTICLES LIKE BOTTLES

Figure 1:
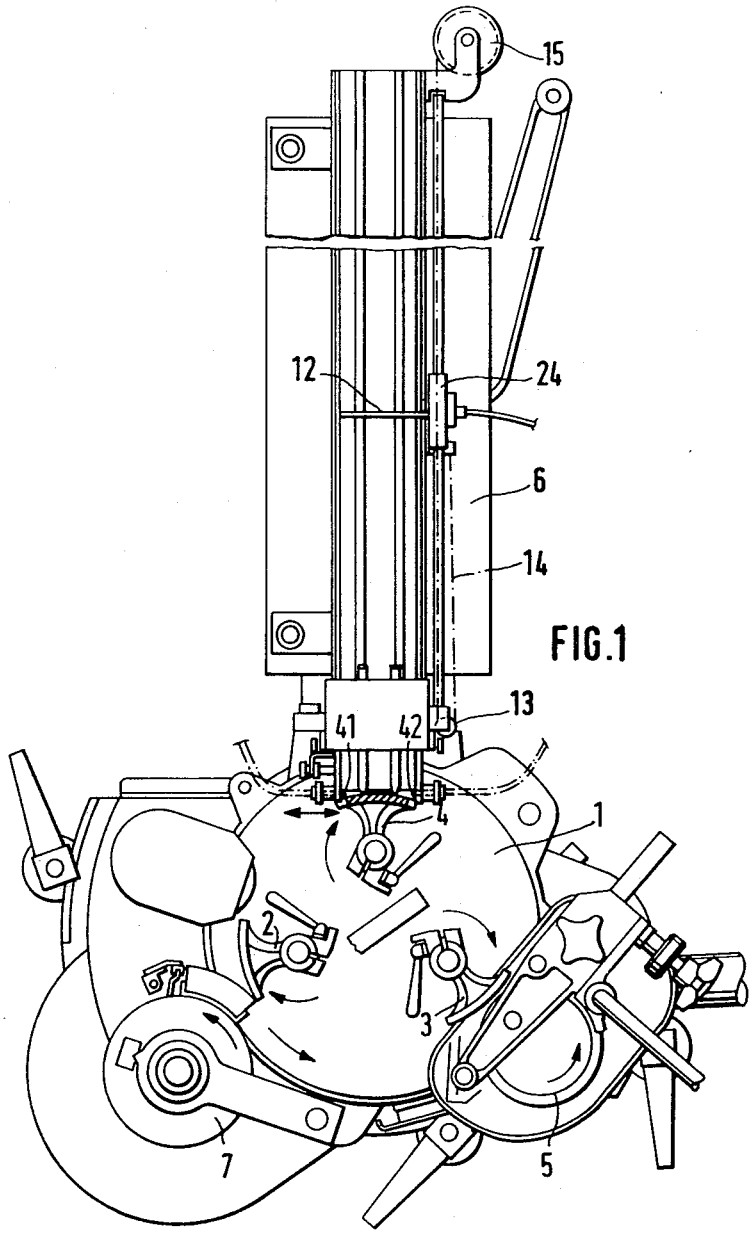

The invention is a labeling station that is intended for articles like bottles, that has at least one revolving or pivoting label grasper-applicator with a capture-and-release surface for taking a label from a stack and applying it to an article to be labeled, and that has holders that hold the edge of the stack of labels.

In one known labeling station of this type the capture-and-release surface is either covered with an adhesive or provided with suction nozzles for grasping and removing the top label from the stack. Surface adhesion must be powerful enough to overcome the retentive force of the stack holders, which are small hooks that project only slightly beyond the edge of the front of the stack.

Labeling machines must be designed such that the grasper-applicator takes a label from the stack only at a point at which the label can be transferred to an article. If one article is missing from a series to be labeled, the situation will be detected by the controls, which will shift the magazine that holds the stack of labels from a forward position to a rear position in which the grasper-applicator will not be able to reach the front of the stack and remove a label. Before, however, the next label can be removed, the magazine must be shifted back into the forward position. These backwards and forwards shifts can occur only during the interval between the removal of one label and that of the next. If, for example, a labeling station has three grasper-applicators mounted on one revolving carriage and must apply 50,000 labels per hour, the interval between the removal of one applicator and that of the next will be only a fraction of a second. Since part of this time must be devoted to the actual removal of a label, there remains for the backwards and forwards movement of the magazine only the time between the end of one removal and the beginning of the next removal. Since, although this interval differs from one labeling machine to another, it is always very short, the stack of labels, which is seated loosely in the magazine, is subjected to high acceleration forces These forces, plus the high inertia of the rather massive pile, make the pile start to skidding back and forth inside the magazine, so that clean removal of the labels with the capture-and-release surface rocking against the front of the pile can no longer be ensured.

The present invention is a labeling station of the type described above that will reliably remove a label from the stack when the series of articles to be labeled is continuous and interrupt the removal sequence when an article is missing, performing even under difficult labeling conditions, when the labels are fragile for example.

The invention attains this objective by incorporating stack holders, or supplementary holders that hold the edge of the stack, that can be adjusted so that the retentive force they exert on the labels is greater than the attractive force exerted by the capture-and-release surface and, when the stack is held in a moving magazine, than the inertia exerted by the stack of labels on the stack holders as the magazine moves backwards.

The labeling station in accordance with the invention can handle the labels individually subject to momentary operating requirements like the presence or absence of an article in the labeling series, facilitating the removal of a label from the stack when it can be transferred to one of the articles and preventing removal in the absence of an article to be labeled. Even when the stack is a stationary stack, the grasper-applicator will be prevented from removing a label unless the conditions are appropriate because the stack holders are more powerful or because there are supplementary holders that will also be in operation. When adhesive gets on the front of the labels, which occurs when the capture-and-release surface is of the type covered with adhesive, it will cause no problem when a label is removed from the stack during one of the subsequent contacts between the grasper-applicator and the stack. The advantage of the capability for label-removal prevention with a stationary magazine as afforded by the invention is that there is no need for a mechanism to move the magazine back and forth. The masses required to adjust the stack holders are comparatively slight. This provides the labeling station in accordance with the invention with a higher performance than known stations. But it is not only with a stationary but also with a moving magazine that the adjustable stack holders have the advantage because they also prevent the stack from shifting forward in the magazine as it moves backward. The stack of labels is prevented in particular from skidding back and forth in the magazine in one embodiment of the invention, in which there is a sliding bar with a brake in back of the stack. The possibility of shifting the magazine backward is especially useful in combination with the adjustability of the stack holders when there is a sequence of several empty positions in the series of articles to be labeled. This combination of functions can be used to prevent adhesive from getting on the front of the pile when the grasper-applicator comes into contact with it.

In one embodiment of the invention the stack holders are mounted in guides and consist of sliding pins with tips that when in their retracted position overlap the edge of the stack to an extent that still permits the removal of labels. In this design the retracted holders fulfill the function of the conventional hooks whereas when projected they have the novel function of preventing the removal of a label.

Instead of stack holders with this double function it is also possible to employ supplementary holders in the form of sliding pins or of pivoting levers that only overlap the edge of the stack when adjusted to do so.

When the labeling station has a grasper-applicator with a convex capture-and-release surface that rocks against the front of the top label on the stack, it is possible to diminish the load on the label when the device attempts to remove it but is prevented from doing so by the stack holders by making it possible for the sliding pins or pivoting levers to force the front of the stack, or at least the edge of the stack that is in front with respect to the direction in which the capture-and-release surface rocks against it, into a nominal position with respect to the removal of a label from the stack. The stack holders will in this case compress the stack and reliably prevent a label from getting displaced during the initial contact of the grasper-applicator with the stack. This will in particular prevent damage to the front edge, which is the part that is most subject to loading. If the rear stack holders, including both the top and bottom holders can also be adjustable, the front of the stack as a whole can be retracted into a position in which the capacity of the grasper-applicator will be so weak that it will no longer contact it at all. This can be achieved in practice, as already mentioned, with either pins or levers. If pins are employed, they must either be conical or one component of the direction in which they slide must be toward the stack.

When the labeling station has a grasper-applicator with a convex capture-and-release surface that rocks against the front of the top label on the stack, its efficiency will be increased if the adjustable stack holders are mounted on the front and rear edges, in relation to the direction in which the capture-and-release surface rocks, of the stack and the front holders can be adjusted independently of the rear holders. With such a design it is possible to increase the time taken to adjust the holders. Thus the holders on the rear edge can already have been adjusted by the time the rear edge of the capture-and-release surface has released the grasper-applicator but before its rocking motion has been completed. This allows two grasper-applicators to be employed simultaneously on the same stack of labels, one removing a label from the stack while the other is prevented from doing so by the previously adjusted holders. This situation may occur in particular when a large number of grasper-applicators are mounted on one carriage and the labels are relatively long.

The amounts of time available for controlling the grasper-applicators can however also be increased by significantly decreasing the amount of time devoted by the the capture-and-release surfaces to rocking against the front of the stack. Short rocking times can for example be attained by opposing the sense in which the surface revolves or pivots when rocking to the sense in which the carriage and gripper cylinder rotate. Such a labeling station will be more efficient at a smaller number of grasper-applicators per carriage as well as allowing longer intervals between label removal to control the motions.

These longer intervals will also be significant if the adjustable stack holders are used in combination with a magazine that moves backwards and forwards. Furthermore, it is also practical to use a movable magazine with adjustable stack holders. In that case the controls for the mechanism that moves the magazine backwards should not be activated until the the holders have been adjusted.

The stack can be prevented from skidding back and forth in the magazine as a result of the backwards and forwards motion of the magazine by means of a slide that is forced toward the open front of the stack, that supports it from the rear, and that has an adjustable clamp, stop, or similar device that is activated by the controls in accordance with the motion of the magazine as it travels from its forward position into, but before it arrives at, its rear position and as it travels from, but before it leaves, its rear position for its forward position. The controls must also release the clamp, stop, or other device only after a delay that is at least equivalent to the time taken by the magazine to move between the two positions. If the magazine is in the rear position and if it must be filled at that point with new labels, the clamp, stop, or other device must be released so that the labels can be loaded.

One practical device for preventing skidding is a stop that grips the labels from behind on the side opposite the open front, that moves with the labels toward the front, and that can be blocked inside the magazine by an adjustable locking mechanism. Such a stop will support the stack of labels lying in the magazine. If the magazine moves from the forward position into the rear position and is suddenly braked as it arrives there, the inertia of the stack will prevent it from continuing this motion. The motion of the magazine from the rear position into the forward position will on the other hand be immediately transferred to the labels. In this case as well they can not remain in the position but will be immediately moved forward.

Force will usually be applied to the labels toward the open front of the magazine by a slide that grips the labels on the side facing away from the open front. In one embodiment of the invention the slide can also serve as the stop.

The locking mechanism can be mounted on a rail that runs along the magazine and is supported on it. Friction locking mechanisms work well. The locking mechanism can obstruct the stop continuously along the magazine. To shift the stop easily in the magazine it can pivot around an axis that parallels, or slide along an axis that crosses, the longitudinal axis of the magazine. It is preferable for the stop to be fastened to the locking mechanism. Sliding across the longitudinal axis of the magazine is especially necessary when two magazines are mounted one above the other, for example, and there is not enough open space above the bottom one.

Piston-and-cylinder systems work well as drives for both the magazine and the locking mechanism.

The invention will now be specifically described with reference to the drawings, which illustrate one embodiment.

Figure 2:
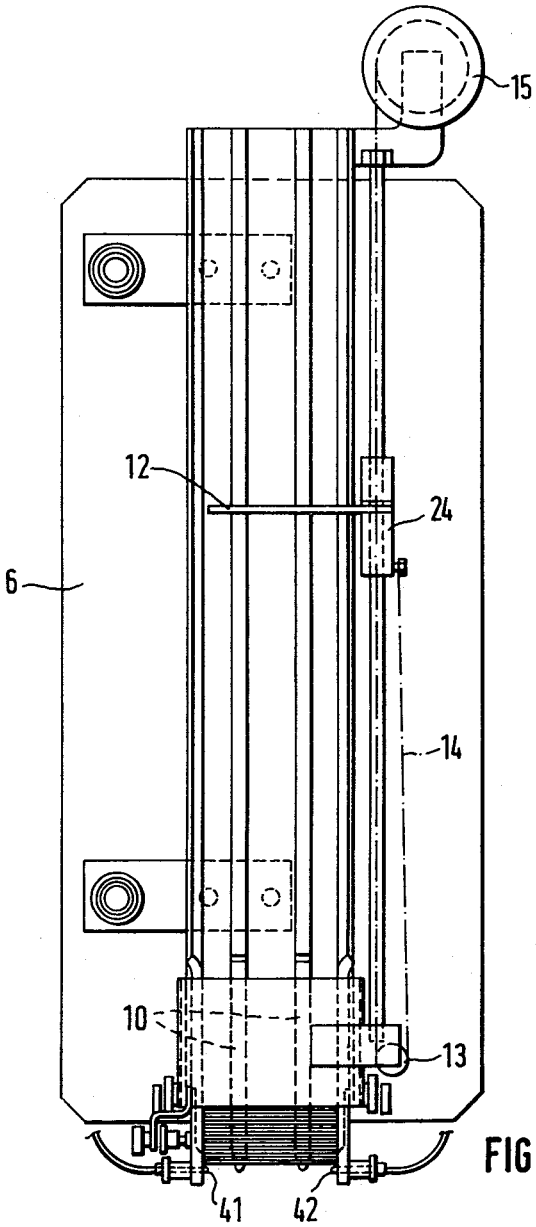
Figure 3:
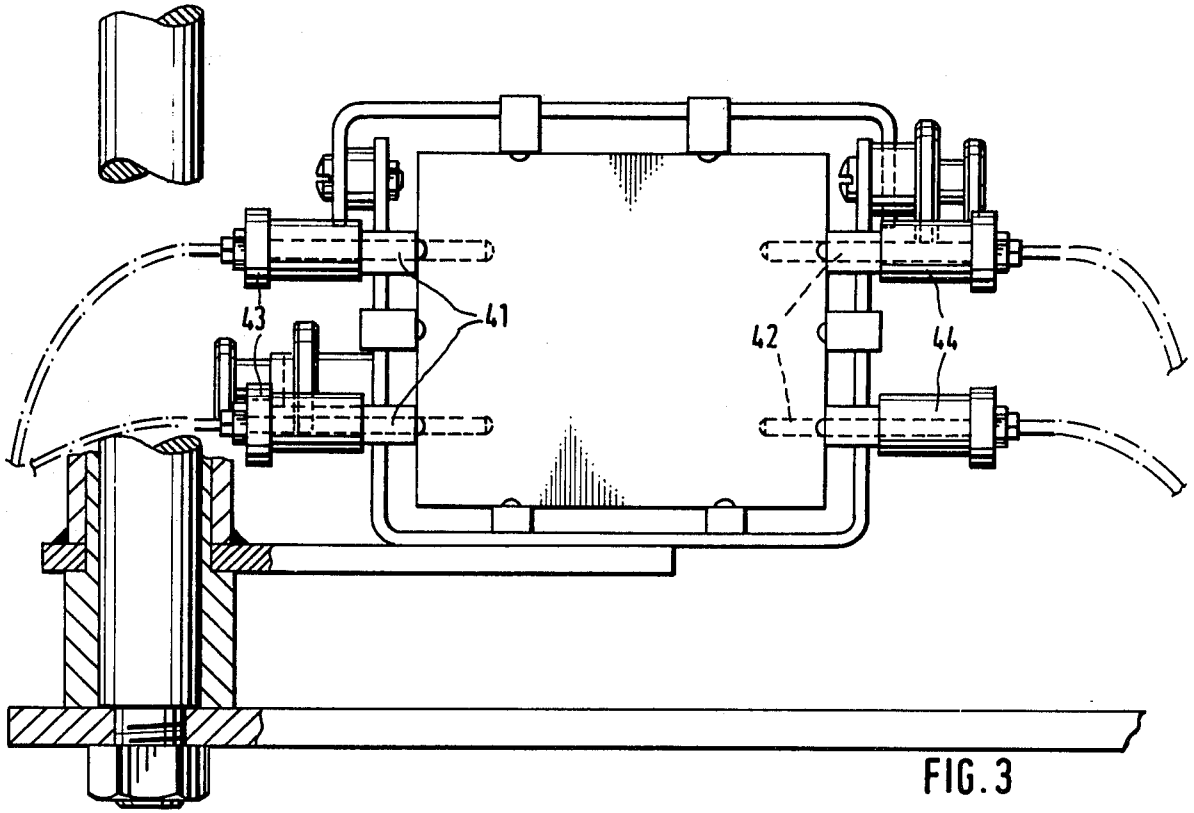
Figure 4:
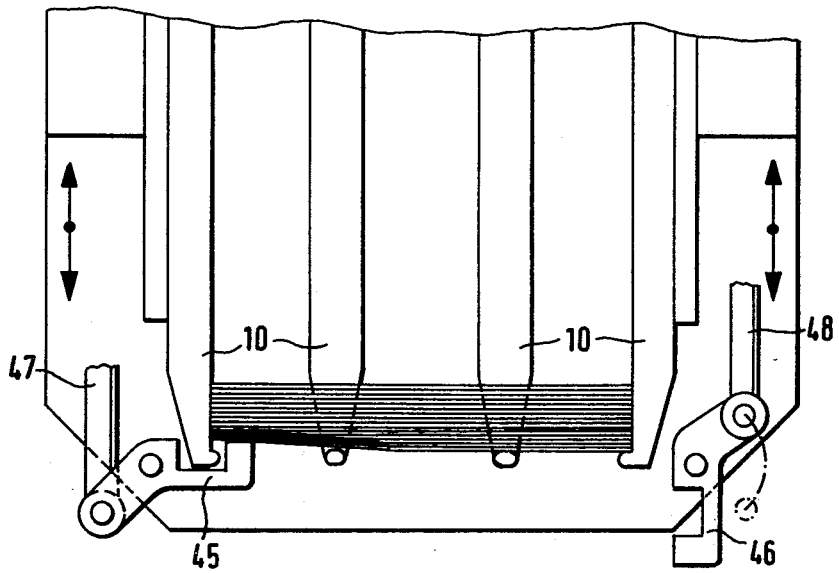
Figure 5:
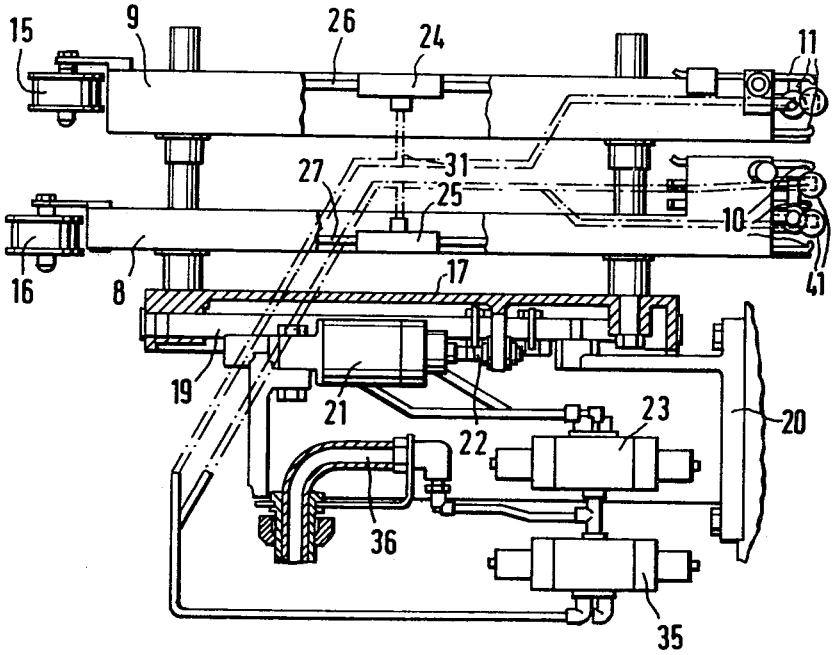
Figure 6:
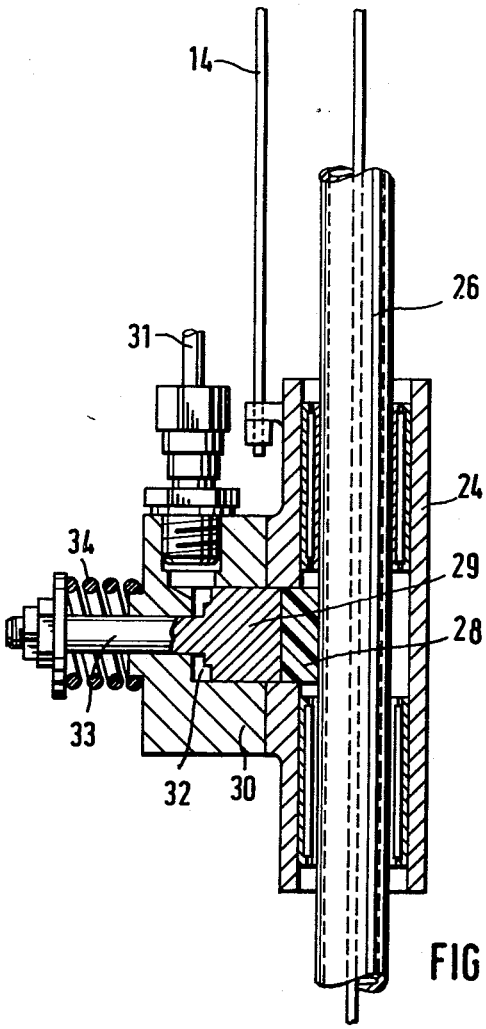

FIG. 1 is a schematic overhead view of the labeling station of a labeling machine with a label magazine that shifts backwards and forwards, FIG. 2 an enlarged overhead view of the magazine in FIG. 1, FIG. 3 an enlarged front view of the magazine in FIGS. 1 and 2, FIG. 4 an overhead view of the front of a variation of the magazine in FIGS. 1 through 3, FIG. 5 a side view of the magazine in FIG. 1 with its drive mechanism, and FIG. 6 a mechanism that blocks a slide on the magazine in FIG. 5.

The labeling device in FIG. 1 consists of a rotating carriage 1 on which are mounted three rotating or swinging grasper-applicators 2, 3, and 4, of a rotating adehesive roller 5, of a label magazine 6, and of a gripper cylinder 7.

The geometry and drive mechanisms of such a labeling device are known (DE-OS 1 435 568). The concave capture-and-release surface of each of grasper-applicators 2–4 rocks against the surface of each station, against, that is, adhesive roller 5, where it picks up adhesive, against the front of the stack of labels in magazine 6, from which it captures a label, and against gripper cylinder 7, where it releases the captured label against the surface of an article to be labeled. When a grasper-applicator is to grasp a label, magazine 6 will be in the forward position illustrated. When, however, no label is to be grasped, magazine 6 will have been retracted so that the capture-and-release surface of a grasper-applicator 2–4 can not rock against the front of the stack and label capture will be prevented.

The magazine illustrated consists of two compartments 8 and 9 mounted one above the other, one for body labels and the other for neck labels. Compartments 8 and 9 are open at the top and rear so that they can be loaded with stacks of labels from the top or rear. The have guide strips 10 and 11 at the front that are provided with hooks that point inwards to restrain the pile of labels. Only grasper-applicators 2–4 can remove a label from the stack. Plate-shaped slides 12 in each compartment 8 and 9, under constant tension provided by traction mechanisms 14 mounted over a deflection pulley 13, advance the labels. The tension derives from a takeup wheel 15, 16 powered by a flat coil spring.

Both compartments 8 and 9 are mounted on a common bed 17 that slides backwards and forwards on a track 19. Track 19 is mounted on a bracket 20 on the machinery frame. Bracket 20 also supports a piston-and-cylinder drive 21 with a moving piston rod 22 that is coupled to track bed 17. Force can be applied to the piston-and-cylinder drive from two directions through a valve 23. Drive 21 shifts magazine compartments 8 and 9 backwards and forwards on track 19.

The slide 12 in each compartment 8 and 9 is mounted at a fixed angle and can slide along a slot that crosses the longitudinal axis of the magazine in a guide sleeve 24, 25 that rotates on and slides along a rod 26, 27. Sleeve 24 has a radial bore in which a barrier 28 moves. When pressure is applied to barrier 28 toward rod 26, the barrier will keep sleeve 24 from moving along the rod.

Pressure is applied to barrier 28 by means of a piston-and-cylinder mechanism that consists of piston 29 and a cylindrical housing 30. Barrier 28 is mounted on the front of piston 29 and housing 30 is connected to sleeve 24. Fluid is supplied to cylinder space 32 through supply line 31. Retraction rod 33 is attached to piston 29 and tensioned by a spring 33. This mechanism retracts piston 29 and hence barrier 28 from rod 26 when the piston is inactive, allowing sleeve 24 to slide freely along the rod.

Fluid is supplied to line 31 from a control valve 35. Valves 23 and 35 are connected to a common feed line 36.

As long as the article-presence detector, which is not illustrated but is of the type known in labeling stations (DE-AS 2 838 158), does not emit a signal indicating that an article is missing from the series to be labeled, the magazine will be in the forward position and barrier 28 will be affected only by spring 34, so that sleeve 29 can slide freely along rod 26. As soon, however, as the absence of an article is communicated to the controls, which are not illustrated in detail, they will activate valves 23 and 35.

The controls are designed in accordance with the response times of the concerned components so that sleeves 24 and 25 will restrain their associated slide 12 on rods 26, 27 as magazine compartments 8, 9 shift from their forward and into, but before they arrive at, their rear position. This ensures that, when the magazine brakes as it arrives at its rear position, the inertia of the labels in compartments 8, 9 will not cause them to skid back. The controls are also designed so that magazine compartments 8, 9 will not shift from their rear into their forward position until locking mechanism 24 and 25 has been activated. A delay circuit in the controls ensures that obstruction will be maintained for a specific length of time, at least during the control interval. The locking mechanism will then be released so that slide 12 can be moved in case the magazine has to be reloaded.

The enlarged details in FIGS. 2 and 3 show only the bottom magazine compartment. In addition to the guide strips 11 that have hooked ends and that function as holders, there are pins 41 and 42 that function as two supplementary holders and that can be moved from a retracted position, in which they overlap the edge of the stack to exactly the same extent as the hooks on guide strips 11, into another position, represented by the dot-and-dash lines in FIG. 3. Pins 41 and 42 are mounted on piston-and-cylinder mechanisms 43 and 44, which when activated advance them against the force of a built-in spring.

Pivoting levers 45 and 46 (FIG. 4), which can be coupled through rods 47 and 48 to a drive mechanism, can also be used as supplementary holders instead of pins 41 and 42. In either version, holders 41 and 42 or 45 and 46, which are activated preliminarily or in front of the edge of the stack of labels, hold the front label so securely that it can not be removed from the stack by the grasper-applicator. The holders also ensure that the stack will not skid forward when the magazine moves backward. In their second operating position they exert such a weak force that even fragile labels can easily be removed from the stack.

Both embodiments of the invention allow separate control of the front and rear holders 41 and 42 or 45 and 46, as illustrated for example in FIG. 4, which also shows how holders 45 retract the front edge of the stack from its nominal position and against the hooks on guide strips 10. This clamps the labels against the front edge and counteracts any displacement that may result when the capture-and-release surface rocks against the stack. In this embodiment, the front edge of the stack is retracted to such an extent that the grasper-applicator never contacts this region of the labels.

What is claimed is:

1. In a labeling station that is intended for articles like bottles, that has at least one revolving or pivoting label grasper-applicator with a capture-and-release surface for taking a label from a stack and applying it to an article to be labeled, and that has holders that hold the edge of the stack of labels, the improvement which comprises controls for the holders (41, 42) or supplementary holders (45, 46) that hold the edge of the stack so that the retentive force the holders exert on the labels can be adjusted to be made greater than the attractive force exerted by the catpure-and-release surface of the grasper-applicator (2, 3, 4) and, when the stack is held in a moving magazine, than the inertia exerted by the stack of labels on the stack holders as the magazine (6) moves backwards, the controls haivng a detector that scans the series of articles to be labeled and actuates the controls and the holders (41, 42 or 45, 46) when it senses a condition calling for a label not to be applied.

2. Labeling station as in claim 1 wherein the stack holders (41, 42) are mounted in guides (43, 44) and consist of sliding pins with tips that when in their retracted position overlap the edge of the stack to an extend that still permits the removal of labels.

3. Labeling station as in claim 1, wherein the supplementary holders (45, 46) are sliding pins or pivoting levers that overlap the edge of the stack only when activated.

4. Labeling station as in claim 3, including with a grasper-applicator that has a convex capture-and-release surface that rocks against the front label on the stack when a label is to be removed from the stack, the sliding pins (41, 42) or pivoting levers (45, 46) forcing the front of the stack, or at least the edge of the stack that is in front with respect to the direction in which the capture-and-release surface of the grasper-applicator (2, 3, 4) rocks against it, into a nominal position with respect to the removal of a label from the stack.

5. Labeling station as in claim 3, including a grasper-applicator that has a convex capture-and-release surface that rocks against the front label on the stack when a label is to be removed from the stack, the adjustable stack holders (41, 42 or 45, 46) being mounted on the front and rear edges, in relation to the direction in which the capture-and-release surface rocks, of the stack; the front holders (41 or 45) beind adjustable independently of the rear holders (42 or 46).

6. Labeling station as in claim 1, including a magazine that holds the stack of labels, and means for shifting the magazine backward and forward, the controls activating the mechanism that shifts the magazine backward after the holders (41, 42 or 45, 46) have been adjusted.

7. Labeling station as in claim 6, including a slide that is forced toward the open front of the stack and that supports it from the rear, characterized in that the slide (12) being an adjustable clamp, stop, or similar device that is activated by controls (23, 35) in accordance with the motion of the magazine (8, 9) as it travels from its forward position into, but before it arrives at, its rear position and as it travels from, but before it leaves, its rear position for its forward position.

8. Labeling station as in claim 7, wherein the controls (23, 35) release the clamp, stop, or other device only after a delay that is at least equivalent to the time taken by the magazine (8, 9) to move between the two positions.

9. Labeling station as in claim 7, wherein a stop (12) grips the labels in the magazine (8, 9) on the side facing away from the open front, moves along with them toward the open front, and can be blocked inside the magazine by an adjustable locking mechanism (24-34).

10. Labeling station as in claim 9, wherein, the locking mechanism (24-34) can be blocked along a rod (26, 27) that runs along the magazine (8, 9) and is mounted on it.

11. Labeling station as in claim 9, wherein the stop (12) is fastened to the locking mechanism (24-34).

12. Labeling station as in claim 9, wherein the mechanisms (21, 22, 29, 30, 32) that power the magazine (8, 9) and the locking mechanism (24-34) are piston-and-cylinder mechanisms.

13. Labeling station as in claim 7, wherein the slide that grips the labels from behind on the side facing away from the open front and forces them toward the open front, is a stop (12).

14. Labeling station as in claim 13, wherein the stop (12) pivots around in axis that parallels, or slides along an axis that crosses, the longitudinal axis of the magazine (8, 9).

15. Labeling station as in claim 13, wherein the rods (26, 27) and the locking mechanism (24-34) form guides for the stop (12).

16. Labeling station as in claim 1, wherein each grasper-applicator (2, 3, 4), is mounted eccentrically with respect to its convex capture-and-release surface, is mounted eccentrically on a rotating carriage (1) and pivots or rotates in a sense that is the opposite of the sense in which the carrier (1) and a grasper cylinder rotate, at least while a label is being removed from the stack.

* * * * *

UNITED STATES PATENT AND TRADEMARK OFFICE

CERTIFICATE OF CORRECTION

PATENT NO. : 4,439,262

DATED : March 27, 1984

INVENTOR(S) : Rudolf Zodrow et al

It is certified that error appears in the above-identified patent and that said Letters Patent is hereby corrected as shown below:

| | |
|---|---|
| Col. 6, line 43 | Delete "haivng" and substitute --having-- |
| Col. 6, line 51 | Delete "extend" and substitute --extent-- |
| Col. 6, line 56 | Delete "with" |
| Col. 7, line 5 | After "stack" delete ";" and substitute -- , -- |
| Col. 7, line 5 | Delete "beind" and substitute --being-- |
| Col. 7, line 14 | Delete "characterized in that" |
| Col. 7, line 15 | Delete "being" and substitute --having-- |
| Col. 8, line 16 | Delete "in" and substitute --an-- |

Signed and Sealed this

*Fourth* Day of *December 1984*

[SEAL]

*Attest:*

*Attesting Officer*

GERALD J. MOSSINGHOFF

*Commissioner of Patents and Trademarks*